US008517794B2

(12) United States Patent
Thompson

(10) Patent No.: US 8,517,794 B2
(45) Date of Patent: Aug. 27, 2013

(54) STRETCH MARK PREVENTION UNDERGARMENT

(76) Inventor: Stephen W. Thompson, Naples, FL (US)

( * ) Notice: Subject to any disclaimer, the term of this patent is extended or adjusted under 35 U.S.C. 154(b) by 427 days.

(21) Appl. No.: 12/725,532

(22) Filed: Mar. 17, 2010

(65) Prior Publication Data

US 2011/0230119 A1 Sep. 22, 2011

(51) Int. Cl.
*A41C 3/00* (2006.01)

(52) U.S. Cl.
USPC ..... 450/81; 450/93; 450/92

(58) Field of Classification Search
USPC ..... 450/1, 36, 37, 39, 54–58, 81, 92, 450/93; 2/255, 258, 260, 260.1
See application file for complete search history.

(56) References Cited

U.S. PATENT DOCUMENTS

| | | | | | |
|---|---|---|---|---|---|
| 2,033,065 | A | * | 3/1936 | Galligan | 2/67 |
| 2,294,589 | A | * | 9/1942 | Waterbury | 264/275 |
| D141,777 | S | * | 7/1945 | Ferguson | D2/708 |
| 2,659,085 | A | * | 11/1953 | Ericson | 450/39 |
| 2,669,719 | A | * | 2/1954 | Steiner | 450/39 |
| 2,707,281 | A | * | 5/1955 | Barth | 450/39 |
| 2,765,470 | A | | 10/1956 | Read | |
| 3,080,869 | A | | 3/1963 | Alberts | |
| 3,254,653 | A | * | 6/1966 | Krieger | 450/39 |
| 3,752,164 | A | | 8/1973 | Salisky | |
| 4,506,390 | A | | 3/1985 | Stern | |
| 5,613,893 | A | | 3/1997 | Zagame | |
| 5,897,423 | A | | 4/1999 | Rosenberg | |
| 5,998,693 | A | * | 12/1999 | Zagame | 602/52 |
| 6,332,825 | B1 | * | 12/2001 | Henricksen | 450/81 |
| 6,537,132 | B1 | | 3/2003 | Alberts | |
| 6,548,728 | B1 | * | 4/2003 | Faries et al. | 602/42 |
| 6,927,316 | B1 | * | 8/2005 | Faries et al. | 602/43 |
| 7,303,539 | B2 | * | 12/2007 | Binder et al. | 602/75 |
| 7,540,850 | B2 | * | 6/2009 | Guillot | 602/60 |
| 7,645,916 | B2 | * | 1/2010 | Rasor | 602/44 |
| 7,934,507 | B2 | * | 5/2011 | Brooks | 128/873 |
| 8,084,051 | B1 | * | 12/2011 | Dillon | 424/402 |
| 2003/0167028 | A1 | * | 9/2003 | Binder et al. | 602/2 |
| 2006/0129081 | A1 | * | 6/2006 | Binder et al. | 602/60 |

FOREIGN PATENT DOCUMENTS

| | | |
|---|---|---|
| CN | 200959829 | 10/2007 |
| EP | 0988803 | 3/2000 |
| JP | 2007131973 | 5/2007 |

* cited by examiner

*Primary Examiner* — Gloria Hale
(74) *Attorney, Agent, or Firm* — Edward M. Livingston, Esq.; Bryan L. Loeffler, Esq.; The Livingston Firm

(57) ABSTRACT

Stretch mark prevention undergarments (1) worn around a woman's abdomen, chest, lower torso, legs, buttocks and other areas for reinforcing elastic fibers in the skin and preventing stretch marks. The stretch mark prevention undergarment has an outer layer (2) made of stretchable material and an inner layer (8) of webbed material made of a non-slip material (9). The non-slip material maintains a constant adherent traction with the skin of a wearer, thereby reinforcing elastic fibers of skin. The inner layer is arranged in a webbed "fishnet" or other design to allow a wearer's skin to breath through the outer layer of the stretch mark prevention undergarment. The stretch mark prevention undergarment may be in the form of underwear (14), briefs, underpants, panties, leggings (16), corsets, bras (10) or any combination thereof to help prevent stretch marks on various parts of the body.

13 Claims, 3 Drawing Sheets

STRETCH MARK PREVENTION UNDERGARMENT

BACKGROUND OF THE INVENTION

This invention relates to stretch marks caused during pregnancy, more particularly, to an undergarment that may be worn around the abdomen and other areas of a pregnant woman that reinforces the elastic fibers of the skin around the expanding abdomen.

Many women develop stretch marks on their abdomens, chests, legs, buttocks and other areas during pregnancy. Stretch marks are caused by the growth of the baby and rapid expansion of the skin around these areas. Factors that contribute to stretch marks include the age of the woman, the size of the baby, being pregnant with multiple babies and weight gained during pregnancy. Stretch marks are caused by tears or breakage of elastic fibers within the dermis. This commonly occurs as a chain reaction, wherein one elastic fiber rips causing nearby elastic fibers to rip. These multiple rips occur in a line which is visible from the exterior of the skin as a stretch mark. The quality of elastic fibers in a women's skin may be influenced by a women's age. For example, an eighteen year old girl will be more susceptible to stretch marks as she will have fewer already stretched the fibers in her skin to near the breaking point. This is because she has just gone through growth spurts as a result of puberty and the skin has not had time to reinforce itself. However, slightly older women will have more time for the fibers to repair themselves after puberty and will therefore be less susceptible to stretch marks because their skin is reinforced. Many women have significantly more elastic fibers in their skin due to genetic factors. This is why some women get little or no stretch marks during pregnancy while others get severe stretch marks with the same size baby and same weight gain.

Currently, many pregnant women apply lotions and topical ointments to their skin as a preventative measure against stretch marks. However, lotions and topical ointments do not actually address the cause of stretch marks because they provide no reinforcement to prevent the skin's elastic fibers from ripping. Furthermore, many of these lotions and topical ointments contain Vitamin-E, which research has shown to be linked to birth defects. Also, creams and lotions only moisten the outer epidermis and do not reach or support the dermis where the stretch marks occur. Other panty hose garments or body shaping garments claim to reduce stretch marks. However, garments such as these only apply pressure on the skin and do not reinforce the elastic fibers found in the dermis.

Therefore, a need exists for a device for reinforcing the skin of pregnant women, thereby preventing the ripping of elastic fibers in the skin and the resulting stretch marks.

The relevant prior art includes the following references:

| Pat. No. (U.S. unless stated otherwise) | Inventor | Issue/Publication Date |
|---|---|---|
| CN200959829 | Ma | Oct. 17, 2007 |
| JP2007131973 | Kureya | May 31, 2007 |
| 6,537,132 | Alberts | Mar. 25, 2003 |
| EP0988803 | Sano | Mar. 29, 2000 |
| 5,897,423 | Rosenberg | Apr. 27, 1999 |
| 5,613,893 | Zagame | Mar. 25, 1997 |
| 4,506,390 | Stern | Mar. 26, 1985 |
| 3,752,164 | Salisky | Aug. 14, 1973 |
| 3,080,869 | Alberts | Mar. 12, 1963 |
| 2,765,470 | Read | Oct. 09, 1956 |

SUMMARY OF THE INVENTION

The primary object of the present invention is to provide a stretch mark prevention undergarment that prevents the formation of stretch marks by reinforcing the elastic fibers of the skin.

Another object of the present invention is to provide a stretch mark prevention undergarment that is breathable and comfortable to wear.

An even further object of the present invention is to provide a stretch mark prevention undergarment that will prevent stretch marks from forming on the abdomen and lower torso of a wearer.

Another object of the present invention is to provide a stretch mark prevention undergarment that will prevent stretch marks from forming on the breasts of a wearer.

An even further object of the present invention is to provide a stretch mark prevention undergarment that will prevent stretch marks from forming on the buttocks and pelvis area of a wearer.

Another object of the present invention is to provide a stretch mark prevention undergarment that will prevent stretch marks from forming on upper leg and thigh of a wearer.

The present invention fulfills the above and other objects by providing an undergarment worn around a woman's belly for preventing stretch marks. The undergarment has an outer layer made of smooth, stretchable, non-adherent and breathable material, such as Lycra, spandex, etc., and an inner layer of webbed material made of a stretchable non-slip material, such as silicone, rubber, etc. The non-slip material maintains a constant adherent traction with the skin, thereby reinforcing the skin from the outside to prevent the skin from stretching apart. The webbed "fishnet" design allows the skin to breath through the outer layer of the garment. Alternative embodiments of the undergarment include panties, briefs, bands, leggings, corsets, bras or combinations thereof to help prevent stretch marks and provide support.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
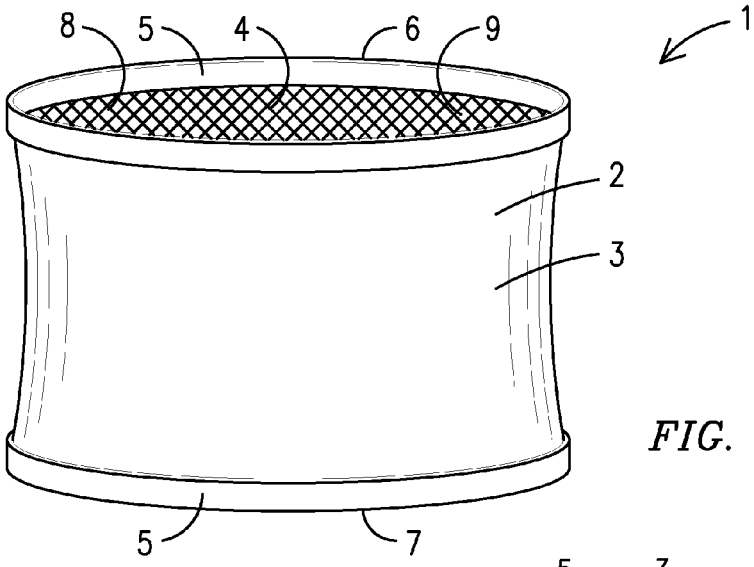
FIG. 1 is a front perspective view of an abdominal stretch mark prevention undergarment of the present invention.

For purposes of describing the preferred embodiment, the terminology used in reference to the numbered accessories in the drawings is as follows:

| | |
|---|---|
| 1. | undergarment |
| 2. | outer layer |
| 3. | outer surface |
| 4. | inner surface |
| 5. | elastomeric band |
| 6. | upper edge |
| 7. | lower edge |
| 8. | inner layer |
| 9. | non-slip material |
| 10. | bra |
| 11. | cup |
| 12. | shoulder strap |
| 13. | rear strap |
| 14. | underwear |
| 15. | leg hole |
| 16. | legging |

Figure 2:
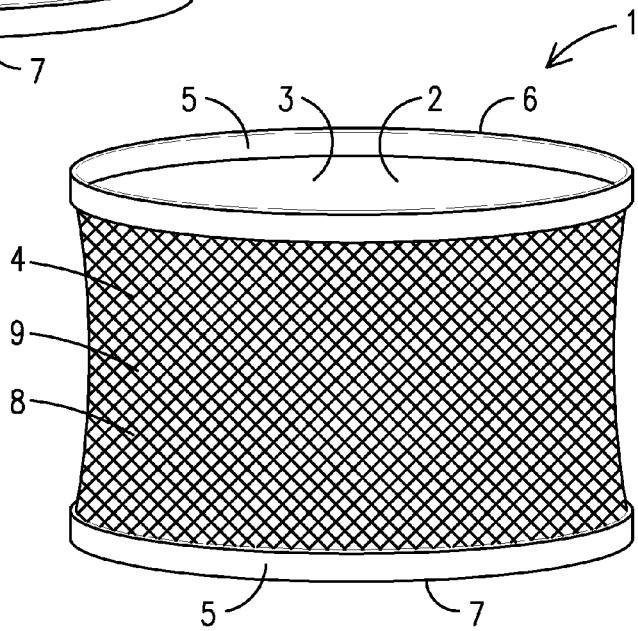
FIG. 2 is a front perspective view of an abdominal stretch mark prevention undergarment of the present invention that has been turned inside-out.

With reference to FIGS. 1 and 2, in which views of an abdominal stretch mark prevention undergarment 1 of the present invention is shown. The undergarment 1 is substantially tubular in shape and has an outer layer 2 having an outer surface 3 and an inner surface 4. The outer layer 2 is made of stretchable breathable material, such as Lycra, spandex, etc. Elastomeric bands 5 are located along an upper edge 6 and a lower edge 7 of the undergarment 1. The elastomeric bands 5 assist in keeping the undergarment 1 in place while being around the lower torso of a wearer, as shown further in FIG. 6. An inner layer 8 made of a non-slip material 9, such as silicone, rubber etc. in located on the inner surface 4 of the outer layer 2 of the undergarment 1. The inner layer 8 is preferably arranged in a webbed "fishnet," diamond-shaped or similar pattern to allow the wearer's skin to make contact with both the inner layer 8 and the outer layer 2 of the undergarment 1, thereby allowing the skin to breathe. The non-slip material 9 of the inner layer 8 maintains a constant adherent traction with the skin of the wearer, thereby preventing the skin around the body from stretching apart and the elastic fibers of the skin from tearing.

Figure 3:
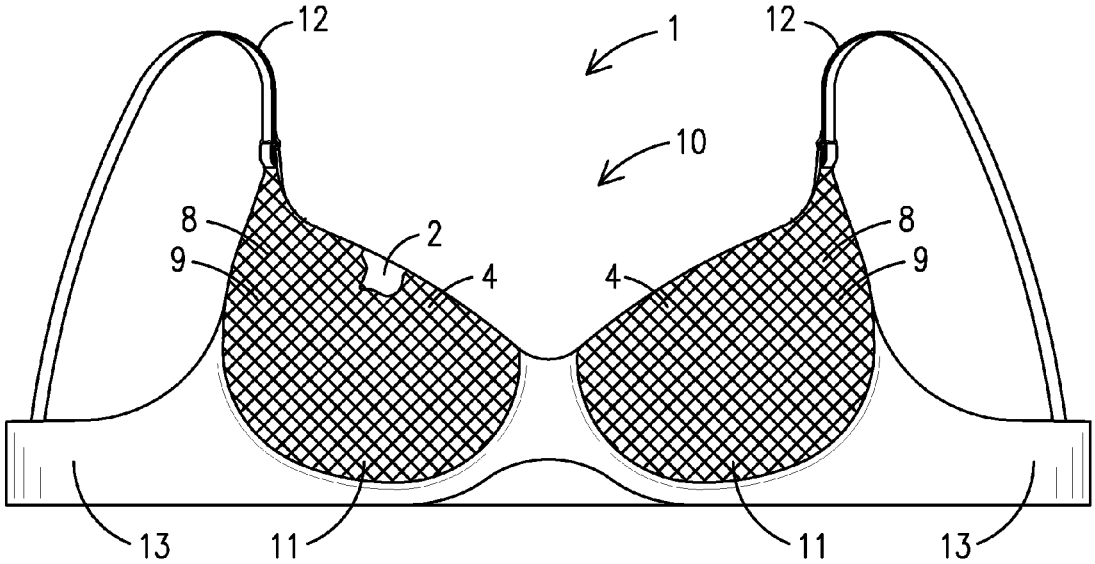
FIG. 3 is a rear view of a stretch mark prevention undergarment of the present invention in the form of a bra.

With reference to FIG. 3, a rear view of a stretch mark prevention undergarment 1 of the present invention in the form of a bra 10 is shown. The undergarment 1 is a bra 10 having cups 11 for supporting the breasts of a wearer. The cups 11 have an outer layer 2 with an outer surface 3 and an inner surface 4. The outer layer 2 is made of stretchable breathable material, such as Lycra, spandex, etc. An inner layer 8 made of a non-slip material 9, such as silicone, rubber, etc., is located on the inner surface 4 of the outer layer 2 of the undergarment 1. The inner layer 8 is preferably arranged in a webbed "fishnet" pattern to allow the wearer's skin to make contact with both the inner layer 8 and the outer layer 2 of the undergarment 1, thereby allowing the skin to breathe. The non-slip material 9 of the inner layer 8 maintains a constant adherent traction with the skin of the wearer, thereby preventing the skin around the breasts from stretching apart and the elastic fibers of the skin from tearing. The outer layer 2 comprises a smooth non-adherent material that will not adhere to outer clothing, thereby allowing the outer clothing to lie smoothly against the stretch mark prevention undergarment 1. Shoulder straps 12 connect the upper portion of the cups 11 to rear straps 13 assist in keeping the undergarment 1 in place while being around the upper torso of a wearer, as shown further in FIG. 6.

Figure 4:
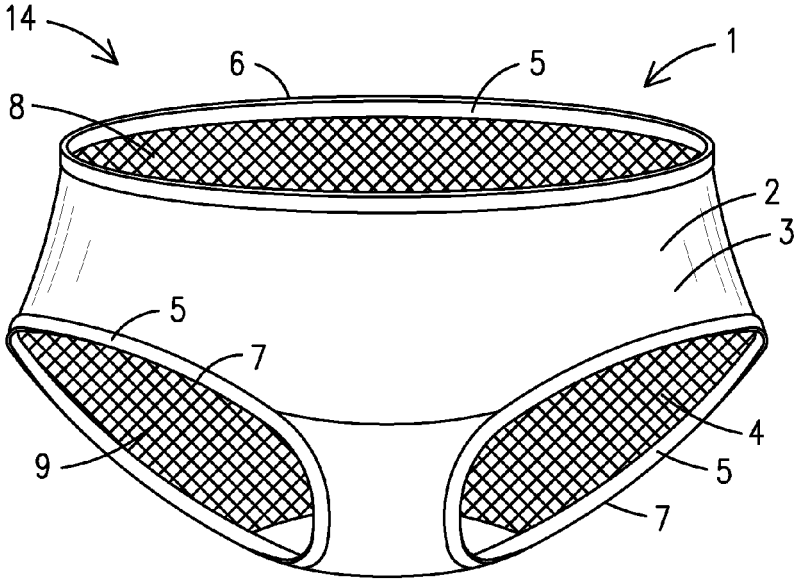
FIG. 4 is a front view of a stretch mark prevention undergarment of the present invention in the form of underwear.

With reference to FIG. 4, a front view of a stretch mark prevention undergarment 1 of the present invention in the form of underwear 14 is shown. The undergarment 1 is a pair of underwear 14 or panties having an outer layer 2 with an outer surface 3 and an inner surface 4. The outer layer 2 is made of stretchable breathable material, such as Lycra, spandex, etc, that is smooth and non-adherent so as to not adhere to outer clothing. Elastomeric bands 5 are located along an upper edge 6 and lower edges 7 of the undergarment 1. The lower edges 7 form leg holes 15. The elastomeric bands 5 assist in keeping the undergarment 1 in place while being around the pelvis area of a wearer, as shown further in FIG. 6. An inner layer 8 made of a non-slip material 9, such as silicone, rubber etc. in located on the inner surface 4 of the outer layer 2 of the undergarment 1. The inner layer 8 is preferably arranged in a webbed "fishnet" or other pattern of lines of non-slip material 9 to allow the wearer's skin to make contact with both the inner layer 8 and the outer layer 2 of the undergarment 1, thereby allowing the skin to breathe. The non-slip material 9 of the inner layer 8 maintains a constant adherent traction with the skin of the wearer, thereby preventing the skin around the pelvis area, buttocks and crotch from stretching apart and the elastic fibers of the skin from tearing. The outer layer 2 is smooth and non-adherent, thereby not adhering to outer clothing.

Figure 5:
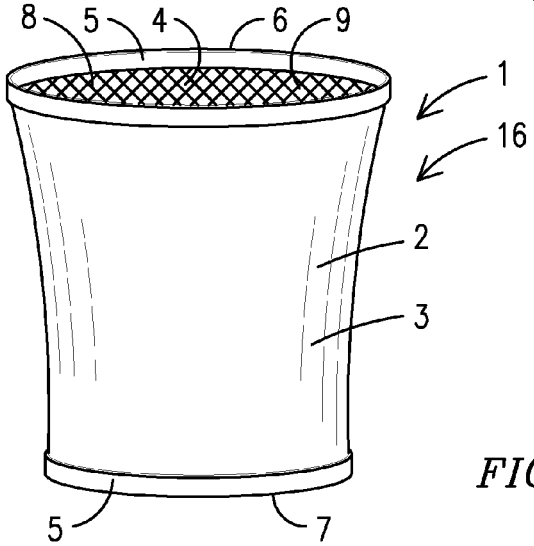
FIG. 5 is a front view of a stretch mark prevention undergarment of the present invention in the form of a legging.

With reference to FIG. 5, a front view of a stretch mark prevention undergarment 1 of the present invention in the form of a legging 16 is shown. The undergarment 1 is substantially tubular in shape and has an outer layer 2 having an outer surface 3 and an inner surface 4. The outer layer 2 is made of stretchable breathable material, such as Lycra, spandex, etc. Elastomeric bands 5 are located along an upper edge 6 and a lower edge 7 of the undergarment 1. The elastomeric bands 5 assist in keeping the undergarment 1 in place while being around the upper leg or thigh a wearer, as shown further in FIG. 6. An inner layer 8 made of a non-slip material 9, such as silicone, rubber etc., is located on the inner surface 4 of the outer layer 2 of the undergarment 1. The inner layer 8 is preferably arranged in a webbed "fishnet" or other pattern to allow the wearer's skin to make contact with both the inner layer 8 and the outer layer 2 of the undergarment 1, thereby allowing the skin to breathe. The non-slip material 9 of the inner layer 8 maintains a constant adherent traction with the skin of the wearer, thereby preventing the skin around the upper leg and thigh from stretching apart and the elastic fibers of the skin from tearing.

Figure 6:
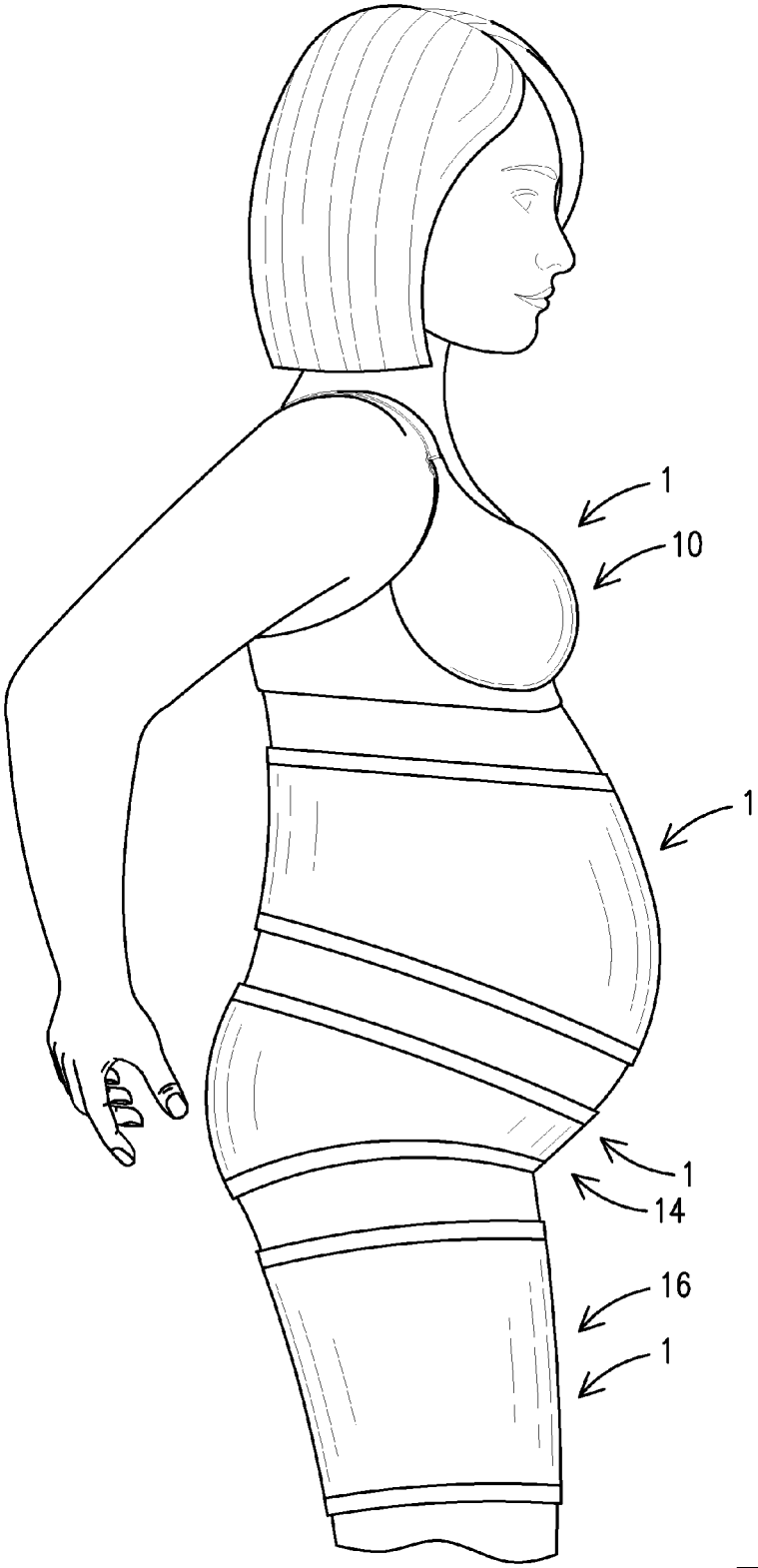
FIG. 6 is a side view of multiple stretch mark prevention undergarments of the present invention being worn.

Finally with reference to FIG. 6, a side view of multiple stretch mark prevention undergarments 1 of the present invention being worn is shown. The stretch mark prevention undergarments 1 include a bra 10 for preventing stretch marks on the breasts, an undergarment 1 for preventing stretch marks around on the abdomen and lower torso, a pair of underwear 14 for preventing stretch arks on the buttocks and pelvic region and an undergarment 16 for preventing stretch marks on the upper leg and thigh. In addition, any or all of these units can be combined into a single garment.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A stretch mark prevention garment for use in preventing stretch marks caused by expansion and stretching of skin in an individual, said stretch mark prevention garment comprising:

a substantially tubular shaped outer layer of material having an inner surface, an outer surface, upper edge and a lower edge;

said substantially tubular shaped outer layer of material being made of a breathable material having elastomeric properties that provide an inward tension on a body of a wearer;

an inner layer made of a non-slip material located on the inner surface of the outer layer that maintains a constant adherent traction with the skin of the wearer that in combination with the outer layer opposes any stretching forces on the wearer's skin that contribute to creation of stretch marks; and said inner layer being arranged in a webbed fishnet pattern of lines on the inner surface of the outer layer to allow a wearer's skin to make contact with both the inner layer of non-slip material and the inner surface of the outer layer, thereby allowing air to pass through the outer layer of breathable material and to come into contact with the wearer's skin.

2. The stretch mark prevention garment of claim 1 wherein: said inner layer is made of silicone.

3. The stretch mark prevention garment of claim 1 wherein: said inner layer is made of rubber.

4. The stretch mark prevention garment of claim 1 further comprising:

at least one elastomeric band located along the upper edge of the stretch mark prevention undergarment.

5. The stretch mark prevention garment of claim 1 further comprising:

at least one elastomeric band located along a lower edge of the stretch mark prevention undergarment.

6. A stretch mark prevention garment for use in preventing stretch marks caused by expansion and stretching of skin in an individual, said stretch mark prevention garment comprising:

an outer layer of material having an inner surface and an outer surface that forms a bra;

said bra having two cups and at least two straps joining the cups together so the bra may be worn around a wearer's chest while supporting the wearer's breasts in said cups;

said outer layer of material being made of a breathable material having elastomeric properties that provide an inward tension on a body of a wearer;

an inner layer made of a non-slip material located on the inner surface of the outer layer that maintains a constant adherent traction with the skin of the wearer that in combination with the outer layer opposes any stretching forces on the wearer's skin that contribute to creation of stretch marks; and said inner layer being arranged in a webbed fishnet pattern of lines on the inner surface of the outer layer to allow a wearer's skin to make contact with both the inner layer of non-slip material and the inner surface of the outer layer, thereby allowing air to pass through the outer layer of breathable material and to come into contact with the wearer's skin.

7. The stretch mark prevention garment of claim 6 wherein: said inner layer is made of silicone.

8. The stretch mark prevention garment of claim 6 wherein: said inner layer is made of rubber.

9. A stretch mark prevention garment for use in preventing stretch marks caused by expansion and stretching of skin in an individual, said stretch mark prevention garment comprising:

an outer layer of material having an inner surface and an outer surface that forms a pair of underwear that is worn around a wearer's pelvic region;

said pair of underwear being substantially tubular in shape so as to cover a wearer's pubic region and buttocks;

said tubular shaped underwear being connected on a lower edge to create two leg holes;

said outer layer of material being made of a breathable material having elastomeric properties that provide an inward tension on a body of a wearer;

an inner layer made of a non-slip material located on the inner surface of the outer layer that maintains a constant adherent traction with the skin of the wearer that in combination with the outer layer opposes any stretching forces on the wearer's skin that contribute to creation of stretch marks; and said inner layer being arranged in a webbed fishnet pattern of lines on the inner surface of the outer layer to allow a wearer's skin to make contact with both the inner layer of non-slip material and the inner surface of the outer layer, thereby allowing air to pass through the outer layer of breathable material and to come into contact with the wearer's skin.

10. The stretch mark prevention garment of claim 9 wherein:

said inner layer is made of silicone.

11. The stretch mark prevention garment of claim 9 wherein:

said inner layer is made of rubber.

12. The stretch mark prevention garment of claim 9 further comprising:

at least one elastomeric band located along an upper edge of the stretch mark prevention undergarment.

13. A method for preventing stretch marks caused by expansion and stretching of skin in an individual using a garment having an outer layer of material having an inner surface and an outer surface, said outer layer being made of a breathable material having elastomeric properties that provide an inward tension on a body of a wearer, an inner layer made of a non-slip material located on the inner surface of the outer layer, said inner layer being arranged in a web fishnet pattern of lines on the inner surface of the outer layer; said method comprising the steps of:

a. placing said garment on an individual so the outer layer completely surrounds a portion of the individual's body and the inner layer is making contact with the individual's skin;

b. said individual wearing the garment for a prolonged period of time; and c. said inner layer maintaining a constant adherent traction with the skin of the individual that in combination with the outer layer opposes any stretching forces on the individual's skin that contribute to creation of stretch marks.

* * * * *